US006619384B2

(12) United States Patent
Moon et al.

(10) Patent No.: US 6,619,384 B2
(45) Date of Patent: Sep. 16, 2003

(54) HEAT PIPE HAVING WOVEN-WIRE WICK AND STRAIGHT-WIRE WICK

(75) Inventors: Seok-Hwan Moon, Taejon (KR); Ho Gyeong Yun, Jeollabuk-Do (KR); Gunn Hwang, Taejon (KR); Tae Goo Choy, Taejon (KR); Joong Moo Park, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 10/093,977

(22) Filed: Mar. 8, 2002

(65) Prior Publication Data

US 2002/0124995 A1 Sep. 12, 2002

(30) Foreign Application Priority Data

Mar. 9, 2001 (KR) ..... 2001-0012161

(51) Int. Cl.[7] ..... F28D 15/00

(52) U.S. Cl. ..... 165/104.26; 165/104.33; 361/700

(58) Field of Search ..... 165/104.26, 104.21, 165/104.33; 361/700

(56) References Cited

U.S. PATENT DOCUMENTS

| | | | | |
|---|---|---|---|---|
| 4,846,263 | A | 7/1989 | Miyazaki et al. | |
| 5,076,352 | A | 12/1991 | Rosenfeld et al. | |
| 5,219,021 | A | 6/1993 | Edelstein et al. | |
| 6,427,765 | B1 * | 8/2002 | Han et al. | 165/104.26 |

FOREIGN PATENT DOCUMENTS

| | | | | |
|---|---|---|---|---|
| JP | 0016788 | * 1/1982 | ..... | 165/104.26 |
| JP | 0006295 | * 2/1982 | ..... | 165/104.26 |
| SU | 0787873 | * 12/1980 | ..... | 165/104.26 |
| SU | 0800576 | * 1/1981 | ..... | 165/104.26 |
| SU | 0974087 | * 11/1982 | ..... | 165/104.26 |
| SU | 1719866 | * 3/1992 | ..... | 165/104.26 |

OTHER PUBLICATIONS

Steady state modeling and testing of a micro heat pipe by B.R. Babin et al.

Operation Performance of Miniature Heat Pipe with composite wire wick by S. Moon et al.

Thermal Analysis of a micro heat pipe by D. Khrustalev et al.

Stereo–type heat lane heat sink by H. Akachi et al.

Moon, Seok Hwan et al., "Operation Performance of Miniature Heat Pipe with Composite Wire Wick", 2001 Intn'l Symposium of Microelectronics, Oct. 9–11, 2001, pp. 207–211.

* cited by examiner

*Primary Examiner*—Christopher Atkinson
(74) *Attorney, Agent, or Firm*—Blakely, Sokoloff, Taylor & Zafman

(57) ABSTRACT

A heat pipe having a woven-wire wick and a straight fine-wire wick is disclosed. The heat pipe can be easily manufactured and improve a thermal performance of the heat pipe. The heat pipe includes a pipe container; a straight fine-wire wick located in the pipe container, wherein the straight fine-wire wick has a porosity; a woven-wire wick having a plurality of groups of wires spirally woven to form a substantially cylindrical wick, for contacting the straight fine-wire wick to an inner wall of the pipe container, wherein when the woven-wire wick is forced radially and inwardly in order for the woven-wire wick to be inserted into the pipe container, the woven-wire wick has restoration forces in a radial and outward direction from axis of the woven-wire wick and is tightly contact with the inner wall of the pipe container, and wherein ends of the straight fine-wire wick and the woven-wire wick are fixed to ends of the pipe container.

4 Claims, 3 Drawing Sheets

HEAT PIPE HAVING WOVEN-WIRE WICK AND STRAIGHT-WIRE WICK

FIELD OF THE INVENTION

The present invention relates to a heat pipe; and more particularly, to a heat pipe having a woven-wire wick and a straight fine-wire wick, which can be easily manufactured and improve a thermal performance of the heat pipe.

DESCRIPTION OF RELATED ART

Recently, with a remarkable development of electronics and telecommunications, it is increased to use a high speed/large capacity system, so a power consumption of the system or a generated heat per a unit area of the system is increased. In particular, due to the generated heat in the electro-communication components, temperature of the semiconductor is increased, which decreases performance and lifetime of the system. The heat flux generated by a central processing unit (CPU) used for a personal computer (PC) is about 10–30 W/cm$^2$, in future, with increasing integrity of electronic device, it is expected that the generated heat flux in the CPU for the PC would be increased to about 50–100 W/cm$^2$.

In order to disperse and radiate the generated heat, it is generally utilized a heat sink, a fan attached to the heat sink, or an immersion cooling.

The conventional cooling apparatus as mentioned above has many problems in a high heat transport capacity, a loud noise, a large size of the cooling system. As a solution of the problems of the conventional cooling apparatus, it is notified a heat pipe, which is a passive cooling apparatus having no noise and has a good response to the heat and a good transport capacity of the heat.

The heat pipe is an apparatus effectively transferring the heat by non-power even in a little temperature difference between the heat source and the condenser due to the use of latent heat caused by the vaporization and condensation of the fluid carrying heat. It will be described the operating principle of a heat pipe with reference to FIG. 1.

Referring to FIG. 1, the heat pipe has working fluid carrying heat inserted to a pipe container 101 and is sealed in a condition of a vacuum. The heat pipe includes a pipe container 101, a wick and a working fluid, and is largely divided to three part of a evaporator 102, a adiabatic section 103 and a condenser 104. The working fluid absorbs heat and is vaporized at the evaporator 102, its vapor is transported through the adiabatic section 103, and the heat is dispersed at the condenser 104. After dispersing the heat, the working fluid is re-circulated to the evaporator 102 along the surface of an inner wall in a liquid phase, it carries out heat transfer by re-circulating operation of vaporizing and condensing. There is the temperature gradient through the pipe. The temperature of the evaporator is higher than that of the adiabatic section and that of the adiabatic section is higher than that of the condenser. As there exists a vapor pressure gradient along the vapor flow passage, the vapor flow from the evaporator to the condenser. As there also exists a liquid pressure gradient, the condensed liquid flows back from the condenser to the evaporator. Since a velocity of transferring the vapor is similar to the velocity of the sound, the velocity of transferring the heat is very fast.

In such a heat pipe, the thermal performance of the heat pipe may be influenced on kinds and charging amount of the working fluid carrying heat, the vacuum level and the purity of inner part of pipe, etc., but it is particularly important that the condensed liquid flows back effectively from the condenser to the evaporator. Generally, the heat pipe induces capillary force by inserting a wick in order for the circulation of the working fluid carrying heat or by manufacturing grooves inside of a wall with sealing both end parts of the pipe after charging reasonable amount of the working fluid to the inside of pipe in the vacuum environment. That is, re-circulation toward evaporator 102 of condensed liquid at condenser 104 mostly depends on the capillary force. In order to provide the capillary force, a wick may be inserted or grooves are manufactured inside of the pipe container.

The heat pipe may be used in the various inclination angle modes according to application object. At this time, the heat transport capacity of the heat pipe is significantly influenced on performance of the wick inserted into the heat pipe. In particular, the heat pipe applicable for the semiconductor should be operated on a horizontal inclination mode or a top heating mode in many cases. In that case, the heat transport capacity is entirely different in accordance with the performance of the wick. In particular, as a diameter of the heat pipe decreases, the heat transport capacity decreases exponentially. Therefore, the performance of the wick is important to the thermal performance of the heat pipe.

In other words, when the heat pipe is horizontally located or the evaporator is located in upper position than the condenser, in order to provide excellent thermal performance of the heat pipe, it is important not only the kind of the wick but also the capillary force of the wick. For good capillary force, the working fluid should be fast pumped, and therefore, a small pore radius and a good permeability are necessary.

There are many conventional wicks, for example, a screen mesh wick, a groove wick, a fine fiber wick or a sintered wick. However, these conventional wicks have the problem that the heat pipe having a good heat transport capacity is difficult to be manufactured while the heat pipe that can be comparatively easily manufactured has a bad heat transport capacity.

In particular, though the fine fiber wick has a good capillary force, it is difficult to be effectively manufactured because of a small radius of the fine fiber wick.

Also, in these days, with miniaturization of portable electronic products, the excellent capillary force and thermal performance of the wick are necessary, however, the conventional wicks have a problem in the thermal performance.

SUMMARY OF THE INVENTION

Therefore, an object of the present invention is to provide a heat pipe which can be easily manufactured and has an excellent heat transport capacity.

In accordance with an aspect of the present invention, there is provided a heat pipe, including: a pipe container; a straight fine-wire wick located in the pipe container, wherein the straight fine-wire wick has a porosity; a woven-wire wick having a plurality of groups of wires spirally woven to form a substantially cylindrical wick, for contacting the straight fine-wire wick to an inner wall of the pipe container, wherein when the woven-wire wick is forced radially and inwardly in order for the woven-wire wick to be inserted into the pipe container, the woven-wire wick has restoration forces in a radial and outward direction from axis of the woven-wire wick and is tightly contact with the inner wall of the pipe container, and wherein ends of the straight fine-wire wick and the woven-wire wick are fixed to ends of the pipe container.

BRIEF DESCRIPTION OF THE DRAWINGS

Other objects and aspects of the invention will become apparent from the following description of the embodiments with reference to the accompanying drawings, in which.

DETAILED DESCRIPTION OF THE INVENTION

Hereinafter, a heat pipe according to the present invention will be described in detail referring to the accompanying drawings.

Figure 1:
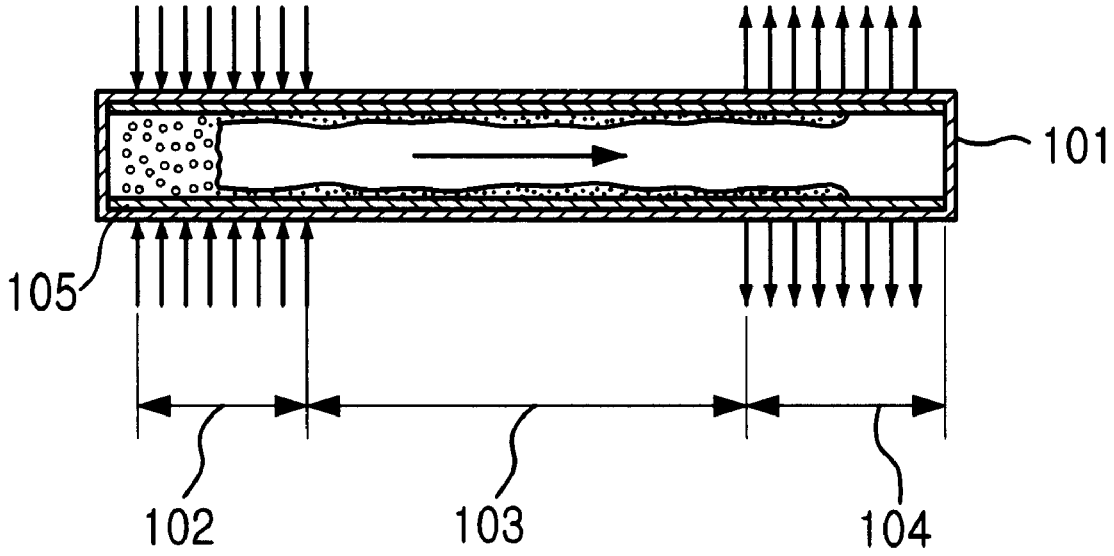
FIG. 1 is a cross-sectional view for explaining the operation principle of a heat pipe.
Figure 2A:
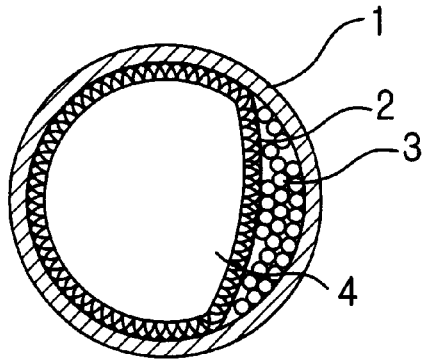
FIGS. 2A and 2B are cross-sectional views of a heat pipe having a woven-wire wick and a bundle-type straight fine-wire wick in a radial direction and in a longitudinal direction in accordance with an embodiment of the present invention.
Figure 2B:
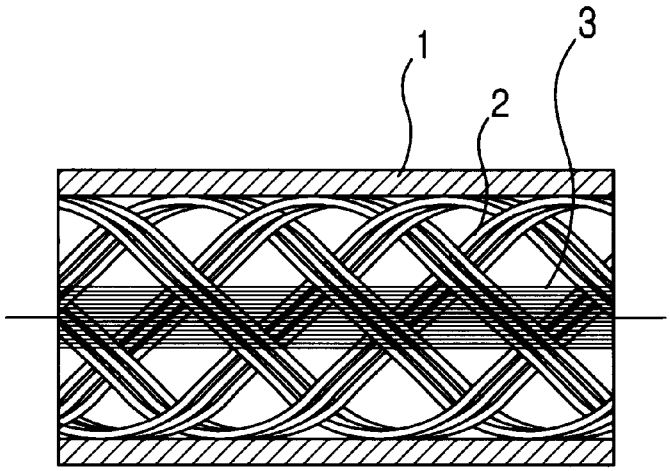

FIGS. 2A and 2B are cross-sectional views of a heat pipe having a woven-wire wick and a bundle-type straight fine-wire wick in a radial direction and a longitudinal direction in accordance with an embodiment of the present invention.

Referring to FIGS. 2A and 2B, a heat pipe in accordance with one embodiment of the present invention includes a woven-wire wick 2 has a good elastic force and a good capillary force and a straight fine-wire wick 3 having a good pore radius and permeability. The fine-wire wick 3 having a group of fine wires is inserted into a part of an inner wall of the pipe container 1, the woven-wire wick 2 having a plurality of groups of wires, each group of wires being spirally woven to form a substantially cylindrical wick, is inserted into the other part of the inner wall of the pipe container 1, and then the heat pipe is sealed so as to fix both ends of the wicks 2 and 3 to the end of the pipe container 1.

When the woven-wire wick 2 is forced radially and inwardly in order for the woven-wire wick 2 to be inserted into the pipe container 1, the woven-wire wick 2 has restoration forces in a radial and outward direction from axis of the woven-wire wick 2 and is tightly contact with the inner wall of the pipe container. In other words, the elastic restoration force and the flexibility of the woven-wire wick 2 make the woven-wire wick closely contact with the inner wall of the pipe container 1, and press the straight fine-wire wick 3 to be fixed between the inner wall of the pipe container 1 and the woven-wire wick 2.

Figure 3A:
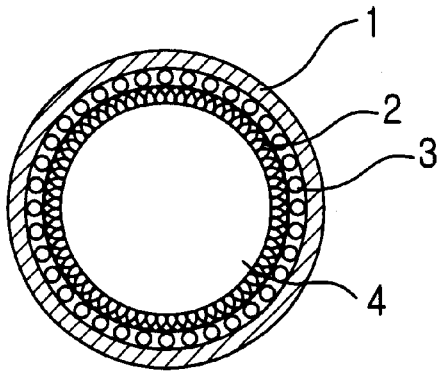
FIGS. 3A and 3B are cross-sectional views of a heat pipe having a woven-wire wick and a circular-type straight fine-wire wick in a radial direction and in a longitudinal direction in accordance with an embodiment of the present invention.
Figure 3B:
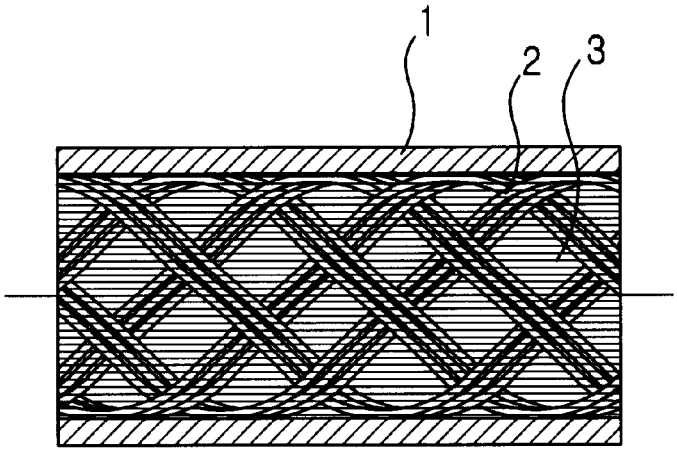

Referring to FIGS. 3A and 3B, a heat pipe in accordance with another embodiment of the present invention has a woven-wire wick 2 and a circular-type straight fine-wire wick 3.

The circular-type straight fine-wire wick 3 having a predetermined number of fine wires is inserted to inside of the pipe container 1, the woven-wire wick having a plurality of groups of wires, each group of wires being woven, is inserted into the inside of the pipe container 1, and then the heat pipe is sealed so as to fix both of the ends of the wicks 2 and 3 to the ends of the pipe container 1. The elastic force of the woven-wire wick 2 makes the straight fine-wire wick 3 to be closely contacted to the inner wall of the pipe container 1.

According to a distribution type of straight fine-wire wick 3, capillary forces of the heat pipes are different from each other.

In one case, a bundle-type straight fine-wire wick as shown in FIG. 2A, there may be resistance when liquid flowing through the straight fine-wire wick 3 is evaporated or condensed, however, a large pumping force can be obtained through a sharp corner edge formed in the bundle type straight fine-wire wick.

In the other case, a circular-type straight fine-wire wick as shown in FIG. 3A, though the sharpness of the corner edge can be decreased, because of regular distribution of the straight fine wires, fast vaporization and condensation between the vaporization space 4 and the wick can be performed, thereby apparently increasing thermal performance of the heat pipe.

The heat pipe in accordance with the present invention can improve the capillary force, because it obtains driving force of the capillary pressure from the woven-wire wick and uses the fine-wire wick having a good permeability.

Also, since the woven-wire wick having a structural elastic force closely contacts the straight fine-wire wick, the straight fine-wire wick can be established without additional adhesion device, thereby easily manufacturing the heat pipe.

While the present invention has been described in connection with specific embodiments accompanied by the attached drawings, it will be readily appreciated that various changes and modifications may be made thereto without departing the spirit of the invention.

What is claimed is:

1. A heat pipe, comprising:

a pipe container;

a straight fine-wire wick located in the pipe container, wherein the straight fine-wire wick has a porosity;

a woven-wire wick having a plurality of groups of wires spirally woven to form a substantially cylindrical wick, for contacting the straight fine-wire wick to an inner wall of the pipe container, wherein when the woven-wire wick is forced radially and inwardly in order for the woven-wire wick to be inserted into the pipe container, the woven-wire wick has restoration forces in a radial and outward direction from axis of the woven-wire wick and is tightly contact with the inner wall of the pipe container, and wherein ends of the straight fine-wire wick and the woven-wire wick are fixed to ends of the pipe container.

2. The heat pipe according to claim 1, wherein the wires of the woven-wire wick are evenly contacted to the inner wall of the pipe container because of an elastic force and a flexibility of the woven-wire wick.

3. The heat pipe according to claim 1, wherein the straight fine-wire wick is a bundle type.

4. The heat pipe according to claim 1, wherein the straight fine-wire wick is a circular type.

* * * * *